US007740002B2

(12) United States Patent
Zeng et al.

(10) Patent No.: US 7,740,002 B2
(45) Date of Patent: Jun. 22, 2010

(54) FUEL INJECTOR

(75) Inventors: Yangbing Zeng, Rochester Hills, MI (US); Andreas M. Lippert, Rochester Hills, MI (US); Rodney B. Rask, Grosse Pointe Woods, MI (US); Arun S. Solomon, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 333 days.

(21) Appl. No.: 11/847,673

(22) Filed: Aug. 30, 2007

(65) Prior Publication Data

US 2008/0210199 A1 Sep. 4, 2008

Related U.S. Application Data

(60) Provisional application No. 60/824,507, filed on Sep. 5, 2006.

(51) Int. Cl.
*F02B 17/00* (2006.01)

(52) U.S. Cl. ..... 123/305; 123/295; 239/533.12; 239/585.2

(58) Field of Classification Search ..... 123/305, 123/295; 239/533.12, 584–585.12
See application file for complete search history.

(56) References Cited

U.S. PATENT DOCUMENTS 5,265,562 A 11/1993 Kruse
5,540,200 A * 7/1996 Naitoh et al. ..... 123/299
5,685,485 A * 11/1997 Mock et al. ..... 239/102.2
5,899,390 A * 5/1999 Arndt et al. ..... 239/553
6,045,063 A 4/2000 Koike et al.
6,206,304 B1 3/2001 Koseki et al.
6,622,693 B2 9/2003 Arndt et al.
6,644,267 B2 * 11/2003 Wuerfel ..... 123/298
6,659,074 B2 12/2003 Lippert et al.
6,883,491 B2 4/2005 Arndt et al.
6,971,365 B1 12/2005 Najt et al.
6,983,733 B2 1/2006 Yamashita et al.
2003/0110780 A1 6/2003 Enomoto et al.
2003/0234005 A1 12/2003 Sumisha et al.
2005/0150478 A1 1/2005 Nomura
2005/0081820 A1 * 4/2005 Tanaka et al. ..... 123/295
2007/0000476 A1 1/2007 Mizobuchi et al.

FOREIGN PATENT DOCUMENTS

EP 1020638 A 7/2000
FR 2860557 A 4/2005
WO WO 0190571 A 11/2001

OTHER PUBLICATIONS

Zimmerman,D;Inflammation of Stratified Mixtures in Spray Guided DI Gasoline Engines; 7th Int'l Symp. on IC Diagnostics; May 2006; pp. 107-122; Baden-Baden Kurhaus, Germany.

* cited by examiner

*Primary Examiner*—Erick Solis

(57) ABSTRACT

A fuel injector has a spray nozzle with a plurality of spray discharge orifices, each of which has an elongated cross-section having a major axis orientable to a center electrode of a spark plug in the combustion chamber.

15 Claims, 4 Drawing Sheets

FUEL INJECTOR

CROSS REFERENCE TO RELATED APPLICATIONS

This application claims the benefit of U.S. Provisional Application No. 60/824,507 filed on Sep. 5, 2006 which is hereby incorporated herein by reference.

TECHNICAL FIELD

This invention pertains to fuel injection in an internal combustion engine.

BACKGROUND

One known engine configuration is a spark-ignited, direct-injection (SIDI) engine wherein a fuel injector directly injects fuel into a combustion chamber in close proximity to a spark plug. Known SIDI systems include a spark-ignition, direct-injection, spray-guided engine employing a fuel injector operative at a fuel-rail pressure in the range of 10-20 MPa and adapted to directly inject fuel into a combustion chamber. The engine utilizes optimized high-squish bowled pistons, and variable swirl valve control.

Known injectors used in a spray guided SIDI engine comprise either a multi-hole injector or a piezoelectric hollow-cone injector. In such known types of injectors, injected fuel mass is distributed along the outer edge of a conical spray pattern. As a consequence, little fuel remains around the spark plug, limiting ignition stability and combustion performance. Fuel injected from known multi-hole injectors penetrate deeply into the combustion chamber due to reduced contact area with the surrounding air, especially at heavy loads. Furthermore, fuel injection can be affected by conditions related to fuel temperature, cylinder pressure, and other conditions.

SUMMARY

A fuel injector adapted to inject fuel directly into a combustion chamber of an internal combustion engine includes a spray nozzle mountable to direct a fuel spray into the combustion chamber from a plurality of spray discharge orifices. Each spray discharge orifice includes an opening through a tip of the spray nozzle and an elongated cross-section having a major axis orientable to a center electrode of a spark plug in the combustion chamber.

BRIEF DESCRIPTION OF THE DRAWINGS

One or more embodiments will now be described, by way of example, with reference to the accompanying drawings, in which.

DETAILED DESCRIPTION

Figure 1:
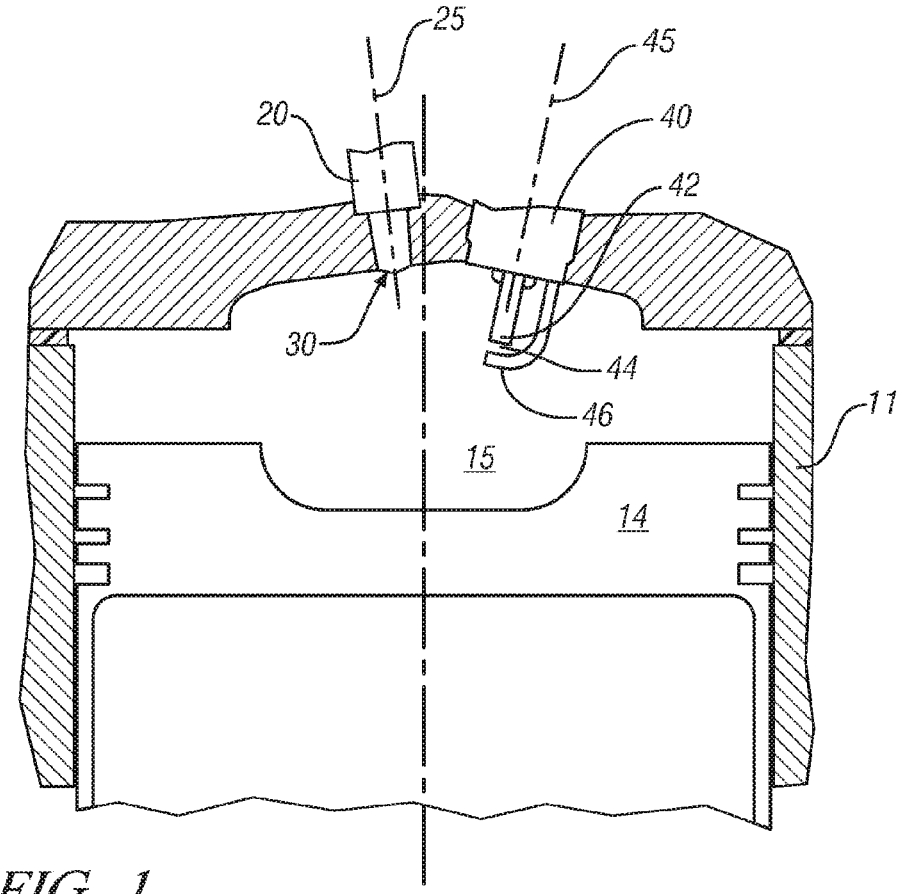
FIG. 1 is a schematic diagram of a combustion chamber in accordance with the present disclosure.

Referring now to the drawings, wherein the showings are for the purpose of illustrating certain exemplary embodiments only and not for the purpose of limiting the same, FIG. 1 schematically depicts a combustion chamber for an internal combustion engine, comprising a spark-ignition, direct-injection (SIDI) internal combustion engine having multiple cylinders. The internal combustion engine is coupled with an engine control module (not shown) operative to execute engine control schemes, based upon operator inputs, ambient conditions, and engine operating conditions. The control module monitors inputs from engine sensors and controls engine actuators including a fuel injector 20 and a spark plug 40.

Each combustion chamber 15 of the internal combustion engine comprises a cylindrical opening in an engine block 11 defining a cylinder, a moveable piston 14, and a cylinder head 12. The top of each piston preferably has a bowl formed therein. The piston is operable to move linearly within the cylinder. The combustion chamber 15 is formed in each cylinder between the bowl in the top of the piston and the cylinder head 12. The cylinder head contains one or more moveable air intake valves and one or more moveable exhaust valves (not shown), the fuel injector 20 and the spark plug 40. The fuel injector 20 injects a predetermined quantity of pressurized fuel directly into the combustion chamber in response to a command from the control module. An injector center line 25 is depicted, consisting of a line defined by a longitudinal axis of the fuel injector 20 and passing through a cross-sectional center thereof. The spark plug 40, comprising a center electrode 42 and a side electrode 46 which together form a gap 44, creates an electric arc in the gap in response to an output from the control module effective to ignite a combustible mixture formed in the combustion chamber. A spark plug center line 45 is depicted, consisting of a line defined by a longitudinal axis of the spark plug 40 and passing through a center of the center electrode 42. The intake valves are operable to open and allow inflow of air and fuel to the combustion chamber. The exhaust valves are operable to open and allow exhaust of products of combustion out of the combustion chamber. Each piston is mechanically operably connected to a crankshaft via a piston rod. The crankshaft is mounted on and rotates in main bearings, in response to linear force applied thereto by the piston rods, as a result of combustion events in each combustion chamber.

The fuel injector 20 preferably comprises an electro-mechanical solenoid device adapted to urge open a flow valve contained therein to meter pressurized fuel from a high pressure fuel line through a tip 30 of a nozzle inserted into an opening into the combustion chamber, in response to a control signal from the control module. The tip of the spark plug and the injector tip 30 are preferably in close proximity, as depicted in FIG. 1, although the disclosure is not so limited.

Figure 2:
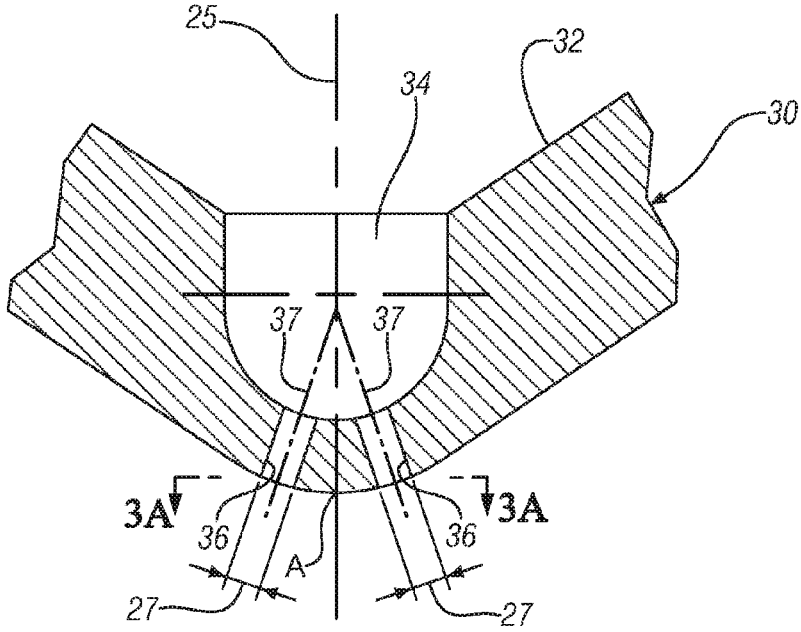
FIG. 2 is a schematic side-view diagram of an injector tip in accordance with the present disclosure.

Referring now to FIG. 2, a cut-away side-view schematic of the tip 30 of the injector nozzle is depicted. The tip 30 is preferably cone-shaped, having an inner valve seat 32 against which the moveable flow valve (not shown), e.g., a needle valve, of the injector seats to seal and prevent fluidic flow when the injector is not activated. The moveable flow valve is selectively actuable to control fluidic flow. There is a sac 34 into which fuel flows, and a plurality of spray orifices or openings 36 through the tip 30, through which fuel passes to the combustion chamber 15. Each of the openings 36 comprises an elongated cross-section orthogonal to a centerline 37 of the opening defining a major axis 27.

Figure 3A:
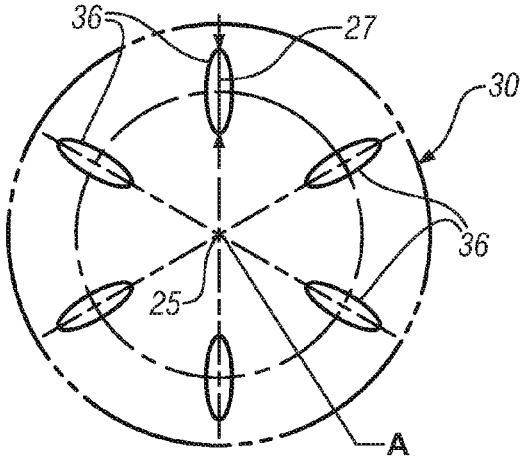
FIG. 3A is a schematic bottom-view diagram of an injector tip in accordance with the present disclosure.

FIG. 3A depicts a schematic bottom view of an embodiment of the tip of the injector nozzle. The tip 30 has a plurality of spray discharge orifices, or openings 36 which pass through the tip from the sac 34 into the combustion chamber 15. Each opening preferably has an elliptical cross-section, the elliptical cross-section defined in relationship to a plane orthogonal to the respective opening centerline 37. Each elliptical opening 36 is defined by major axis 27 and a minor axis, with a ratio between the minor axis and the major axis of the ellipse measuring significantly less than 1.0. Exemplary ratios between the minor axis and the major axis range from approximately 0.05/1.0 to 0.8/1.0. In one embodiment there are six openings 36 for discharging fuel spray, with each of the openings preferably having the same dimensions. The major axis 27 of each of the openings 36 is oriented radially to a point A on the outer surface of the tip 20 that is preferably coincident with the longitudinal axis 25 of the injector 20.

Figure 3B:
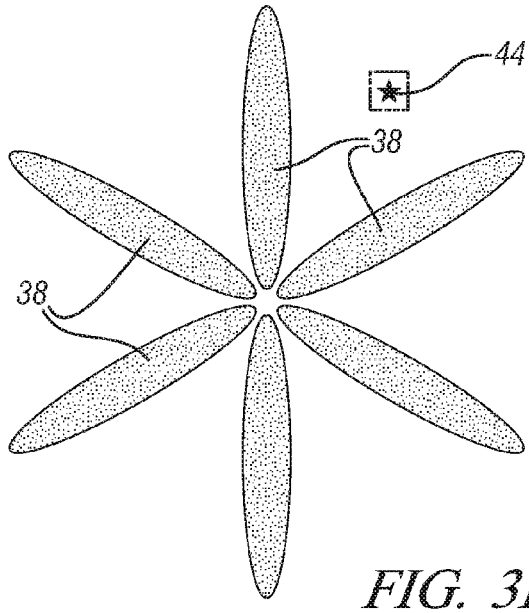
FIG. 3B is a schematic top-view diagram illustrating a fuel spray pattern for an injector tip in accordance with the present disclosure.
Figure 3C:
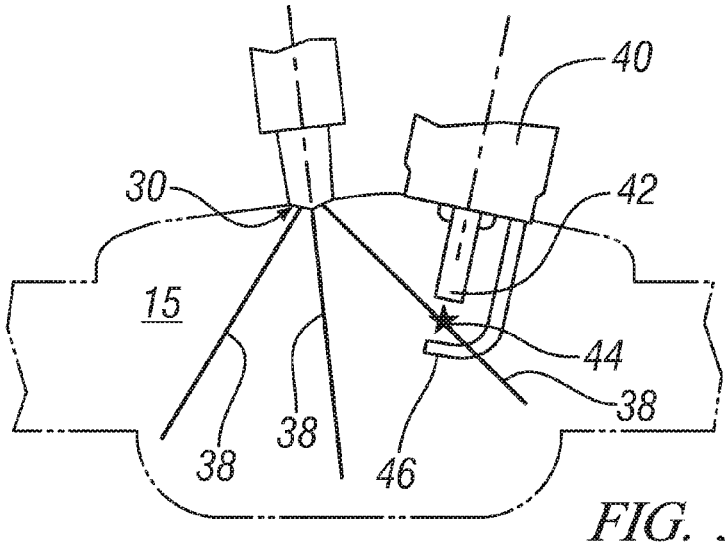
FIG. 3C is a schematic side-view diagram of a combustion chamber, illustrating a fuel spray pattern in accordance with the present disclosure.

FIG. 3B depicts a top-view of corresponding fuel spray pattern comprising spray plumes 38 produced by flowing pressurized fuel through the openings 36 of the tip 30 of the injector nozzle depicted in FIG. 3A, in relation to the gap 44 of the spark plug 40. FIG. 3C is a schematic side view diagram of the combustion chamber 15 and depicts the tip 30 of the injector, the spark plug 40 including the center electrode 42, gap 44, and side electrode 46, and propagation of the spray plumes 38 extending from openings 36 of the injector tip 30 when the injector valve is opened permitting fuel flow into the combustion chamber. Two of the spray plumes 38 extend proximal to the spark plug gap 44 on sides thereof.

Figure 4A:
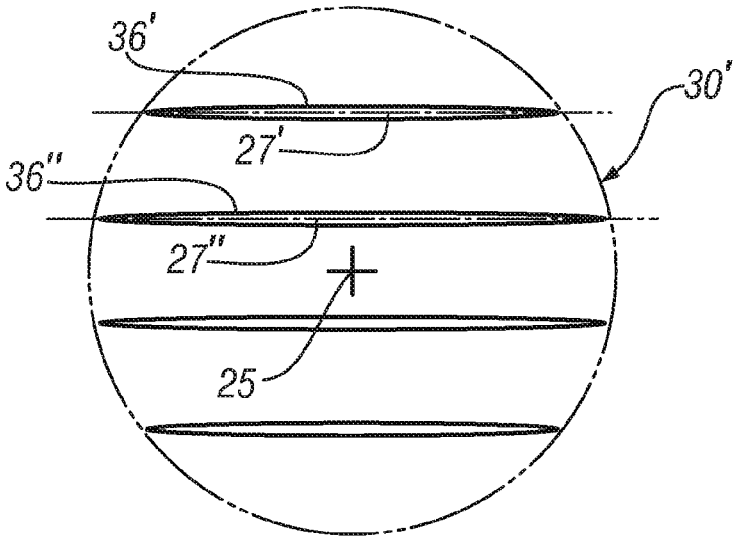
FIG. 4A is a schematic bottom-view diagram of an injector tip in accordance with the present disclosure.

FIG. 4A depicts a schematic bottom view of tip 30', comprising another embodiment of the tip of the injector nozzle. The tip 30' has a plurality of spray discharge orifices, or openings 36', 36". A cross-section of each of the openings is an elongated slit. Each elongated slit opening 36', 36" is defined by a major axis 27', 27" and a minor axis, with a ratio between the minor axis and the major axis of the slit measuring significantly less than 1.0. Exemplary ratios between the minor axis and the major axis range from approximately 0.05/1.0 to 0.8/1.0. Four openings for discharging the fuel spray are depicted, and with two inner openings 36" preferably having a common axial length, and two outer openings 36' preferably having a common axial length that is less that the length of the inner openings 36". The injector is inserted into the cylinder head and indexed such that the major axis 27 of each of the openings 36 is oriented orthogonal to a line (not shown) that is defined by point A on the outer surface of the tip 20 and the spark plug gap 44.

Figure 4B:
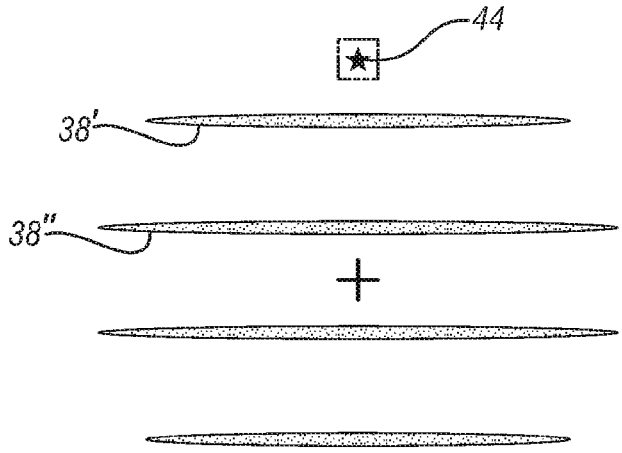
FIG. 4B is a schematic top-view diagram illustrating a fuel spray pattern for an injector tip in accordance with the present disclosure.
Figure 4C:
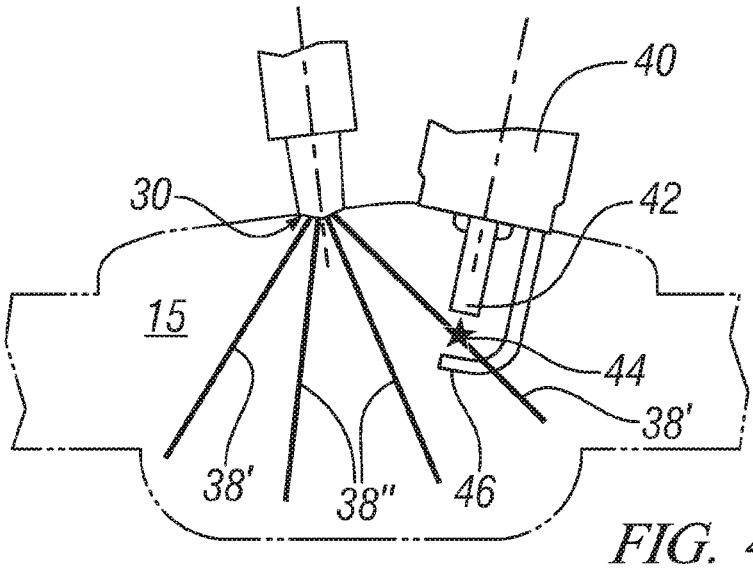
FIG. 4C is a schematic side-view diagram of a combustion chamber illustrating a fuel spray pattern in accordance with the present disclosure.

FIG. 4B depicts a top-view of a corresponding fuel spray pattern comprising spray plumes 38', 38" produced by flowing pressurized fuel through the openings 36', 36" of the tip 30' of the injector nozzle depicted in FIG. 4A, in relation to the gap 44 of the spark plug 40. FIG. 4C is a schematic side view diagram of the combustion chamber 15 and depicts the tip 30' of the injector, the spark plug 40 including the center electrode 42, gap 44, and side electrode 46, and propagation of the spray plumes 38', 38" extending from openings 36', 36" of the injector tip 30' when the injector valve is opened permitting fuel flow into the combustion chamber. As depicted, a planar surface of one of the spray plumes 38' extends proximal to the spark plug gap 44.

Figure 5A:
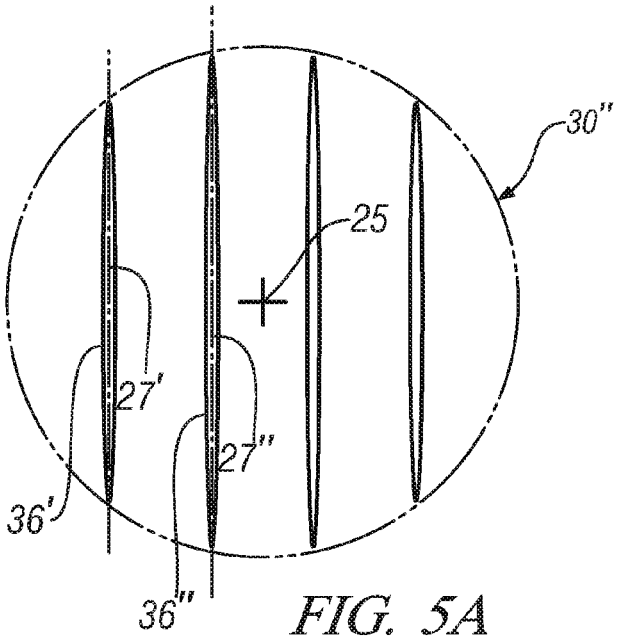
FIG. 5A is a schematic bottom-view diagram of an injector tip in accordance with the present disclosure.

FIG. 5A depicts a schematic bottom view of tip 30", comprising another embodiment of the tip of the injector nozzle. The tip 30" has spray discharge orifices, or openings 36', 36". The cross-section of each of the openings comprising the elongated slit, with each defined by the major axis 27', 27" and a minor axis, with a ratio between the minor axis and the major axis of the slit measuring significantly less than 1.0. Exemplary ratios between the minor axis and the major axis range from approximately 0.05/1.0 to 0.8/1.0. Four openings for discharging the fuel spray are depicted, and with two inner openings 36" preferably having a common axial length, and two outer openings 36' preferably having a common axial length. The injector is inserted into the cylinder head and indexed such that the major axis 27 of each of the openings 36 is oriented parallel to a line (not shown) that is defined by point A on the outer surface of the tip 30" and the spark plug gap 44, such that the defined line falls between the adjacent slits 36".

Figure 5B:
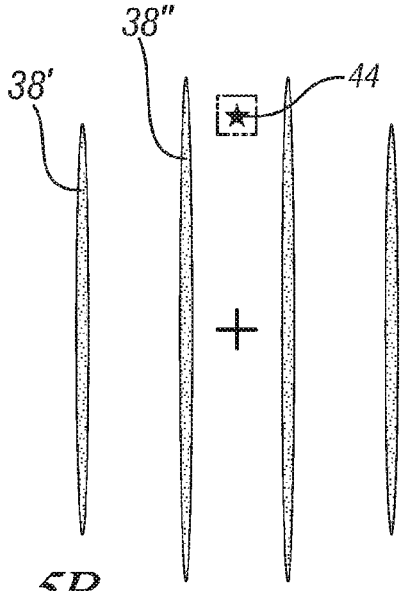
FIG. 5B is a schematic top-view diagram illustrating a spray pattern for an injector tip in accordance with the present disclosure.
Figure 5C:
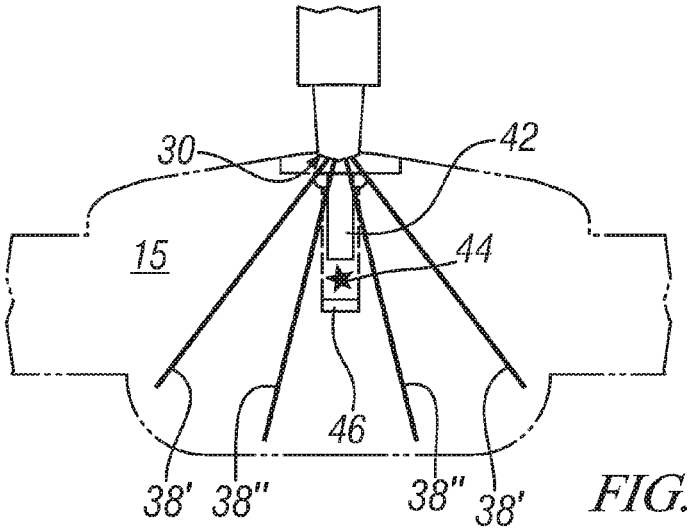
FIG. 5C is a schematic side-view diagram of a combustion chamber illustrating a fuel spray pattern in accordance with the present disclosure.

FIG. 5B depicts a corresponding fuel spray pattern comprising spray plumes 38', 38" produced by flowing pressurized fuel through the openings 36', 36" of the tip 30" of the injector nozzle depicted in FIG. 5A, in relation to the gap 44 of the spark plug 40. FIG. 5C is a schematic side view diagram of the combustion chamber 15 and depicts the tip 30" of the injector, the spark plug 40 including the center electrode 42, gap 44, and side electrode 46, and propagation of the spray plumes 38', 38" from openings 36', 36" of the injector tip 30" when the injector valve is opened permitting fuel flow into the combustion chamber. As depicted, planar surfaces of the spray plumes 38" are proximal to the spark plug gap 44, having a flow pattern such that the planar surfaces of the spray plumes 38" extend proximal to the spark plug gap 44 on each side thereof.

The design of the tip of the injector nozzle with elongated openings 36, 36', 36" results in each fuel injection pulse being substantially shaped as an oval or a planar sheet, increasing the fuel surface area in the combustion chamber. The shaping of the fuel pulse enlarges the contact area between the fuel spray and intake air in the combustion chamber and distributes the fuel charge into the region where initial charge combustion occurs, i.e., the vicinity of the spark plug. The increased fuel spray contact area reduces spray penetration into the combustion chamber, thus retaining more fuel around the spark plug to accelerate combustion and reduce wall-wetting of the combustion chamber. In a further development, the shape of each fan output from the nozzle openings can be adjusted to provide fuel in a middle portion of each spray plume, adapted for different bowl geometries to provide optimum combustion charge conditions at the spark plug. Benefits associated therewith include improved ignition stability, reduced smoke at heavy load, faster and more complete combustion providing an opportunity to reduce hydrocarbons, lower engine-out NOx, and lower dependency on in-cylinder air flow levels. The fuel spray primarily controls the combustion charge for the engine. The fuel injector provides an ignitable mixture at the spark plug gap during spark ignition. Interaction between the fuel spray and surrounding air affects fuel vaporization and formation of the combustion charge, thus affecting ignition of the combustion charge.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A fuel injector configured to inject fuel directly into a combustion chamber of an internal combustion engine, comprising:

a spray nozzle mountable to direct a fuel spray into the combustion chamber, the spray nozzle including a plurality of spray discharge orifices;

each spray discharge orifice comprising an opening through a tip of the spray nozzle, the opening comprising an elliptical cross-section having a major axis oriented relative to a line defined by the tip of the spray nozzle and a center electrode of a spark plug in the combustion chamber; and the fuel injector configured to generate planar spray plumes through the spray discharge orifices;

wherein the major axes of the elliptical cross-sections of the spray discharge orifices are oriented such that a portion of the planar spray plumes extend proximal to the center electrode of the spark plug.

2. The fuel injector of claim 1, wherein the major axes of the elliptical cross-sections of the spray discharge orifices are oriented radial to a center point of the tip of the spray nozzle.

3. The fuel injector of claim 2, wherein the center point of the tip of the spray nozzle is collinear with a longitudinal axis of the injector.

4. The fuel injector of claim 3, wherein the tip of the spray nozzle is substantially cone-shaped.

5. A fuel injector configured to inject fuel directly into a combustion chamber of an internal combustion engine, comprising:

a spray nozzle mountable to direct a fuel spray into the combustion chamber, the spray nozzle including a plurality of spray discharge orifices;

each spray discharge orifice comprising an opening through a tip of the spray nozzle, the opening comprising an elliptical cross-section having a major axis oriented relative to a line defined by the tip of the spray nozzle and a center electrode of a spark plug in the combustion chamber; and the fuel injector configured to generate planar spray plumes through the spray discharge orifices;

wherein the major axes of the elliptical cross-sections of the spray discharge orifices are oriented non-collinear and parallel to the line defined by the tip of the spray nozzle and the center electrode of the spark plug such that a portion of the planar spray plumes extend proximal to the center electrode of the spark plug.

6. The fuel injector of claim 1, wherein the major axes of the elliptical cross-sections of the spray discharge orifices are oriented orthogonal to a line defined by the tip of the spray nozzle and the center electrode of the spark plug.

7. Combustion chamber for an internal combustion engine, comprising:

a moveable piston, a cylinder, and, a cylinder head including a fuel injector and a spark plug;

the fuel injector configured to inject fuel directly into the combustion chamber, said fuel injector including a spray nozzle having a plurality of spray discharge orifices through a cone-shaped tip and mountable to direct a fuel spray into the combustion chamber;

each spray discharge orifice comprising an opening through the cone-shaped tip, the opening comprising an elliptical cross-section with a major axis oriented to a line defined by the cone-shaped tip and a center electrode of the spark plug; and the spray nozzle of the fuel injector oriented in the combustion chamber such the major axes of the elliptical cross-sections of the spray discharge orifices are oriented orthogonal to the line defined by the tip of the spray nozzle and the center electrode of the spark plug.

8. The combustion chamber of claim 7, wherein the major axes of the elliptical cross-sections of the spray discharge orifices are parallel one to another.

9. The combustion chamber of claim 8, wherein the major axes of the elliptical cross-sections of the spray discharge orifices are non-collinear and parallel to the line defined by the cone-shaped tip of the spray nozzle of the injector and the center electrode of the spark plug.

10. The combustion chamber of claim 7, wherein the fuel spray into the combustion chamber comprises a plurality of spray plumes including planar surfaces wherein at least one of the spray plumes extends in close proximity to the spark plug on a side thereof.

11. The fuel injector of claim 1, wherein the plurality of spray discharge orifices comprises two inner openings having a first common axial length, and two outer openings having a second common axial length that is less than the first common axial length.

12. The fuel injector of claim 11, wherein the spray plumes generated through the spray discharge orifices comprising the two inner openings generate spray plumes including planar surfaces extending in close proximity to the spark plug on sides thereof.

13. The fuel injector of claim 12, wherein each spray discharge orifice includes the opening including the elongated cross-section having the major axis and a minor axis, wherein a ratio between the minor axis and the major axis ranges from 0.05/1.0 and 0.8/1.0.

14. The fuel injector of claim 1, wherein the major axes of the elliptical cross-sections of the spray discharge orifices are oriented such that a portion of the planar spray plumes extend proximal to the center electrode of the spark plug and in close proximity to the center electrode of the spark plug on sides thereof.

15. The fuel injector of claim 5, wherein the major axes of the elliptical cross-sections of the spray discharge orifices are oriented such that a portion of the planar spray plumes extend proximal to the center electrode of the spark plug on sides thereof.

* * * * *